US007639196B2

(12) United States Patent
Elliot et al.

(10) Patent No.: US 7,639,196 B2
(45) Date of Patent: Dec. 29, 2009

(54) CELLULAR ANTENNA AND SYSTEMS AND METHODS THEREFOR

(75) Inventors: Robert Douglas Elliot, Naperville, IL (US); Martin L. Zimmerman, Chicago, IL (US); Kevin Eldon Linehan, Rowlett, TX (US); Peter Bruce Graham, Martinborough (NZ); Peter Mailandt, Dallas, TX (US); Louis John Meyer, Shady Shores, TX (US); Philip Sorells, Corinth, TX (US); Andrew Thomas Gray, Pullman, WA (US); Ching-Shun Yang, Naperville, IL (US)

(73) Assignee: Andrew LLC, Hickory, NC (US)

( * ) Notice: Subject to any disclaimer, the term of this patent is extended or adjusted under 35 U.S.C. 154(b) by 567 days.

(21) Appl. No.: 11/399,627

(22) Filed: Apr. 6, 2006

(65) Prior Publication Data

US 2006/0244675 A1 Nov. 2, 2006

Related U.S. Application Data

(63) Continuation-in-part of application No. 10/312,979, filed on Jun. 16, 2003.

(51) Int. Cl.
*H01Q 3/00* (2006.01)

(52) U.S. Cl. ..... 343/757; 343/766; 343/872

(58) Field of Classification Search ..... 343/757, 343/765, 766, 872; 342/359; 455/562.1
See application file for complete search history.

(56) References Cited

U.S. PATENT DOCUMENTS

| | | | | |
|---|---|---|---|---|
| 4,124,852 | A | | 11/1978 | Steudel |
| 4,445,119 | A | | 4/1984 | Works |
| 4,827,270 | A | | 5/1989 | Udagawa et al. |
| 5,115,248 | A | | 5/1992 | Roederer |
| 5,151,706 | A | | 9/1992 | Roederer et al. |
| 5,333,001 | A | | 7/1994 | Profera, Jr. |
| 5,596,329 | A | | 1/1997 | Searle et al. |
| 5,734,349 | A | | 3/1998 | Lenormand et al. |
| 5,751,247 | A | * | 5/1998 | Nomoto et al. ..... 342/359 |
| 5,818,385 | A | | 10/1998 | Bartholomew |
| 5,949,370 | A | | 9/1999 | Smith et al. |
| 6,078,824 | A | | 6/2000 | Sogo |
| 6,097,267 | A | | 8/2000 | Hampel |
| 6,124,832 | A | * | 9/2000 | Jeon et al. ..... 343/711 |
| 6,198,458 | B1 | | 3/2001 | Heinz et al. |
| 6,239,744 | B1 | | 5/2001 | Singer et al. |

(Continued)

FOREIGN PATENT DOCUMENTS

CA 2220745 8/1998

(Continued)

OTHER PUBLICATIONS

International Search Report for PCT/NZ01/00137.

(Continued)

*Primary Examiner*—Tan Ho
(74) *Attorney, Agent, or Firm*—Husch Blackwell Sanders Welsh & Katz

(57) ABSTRACT

There is provided a cellular antenna allowing mechanical azimuth adjustment in combination with adjustment of one or more other antenna attribute such as electrical down tilt, electrical beam width or electrical azimuth adjustment. An integrated control arrangement is provided which can utilise either serial, wireless or RF feed lines to convey communications. A multiband embodiment provides azimuth adjustment for both bands by utilising mechanical and electrical azimuth adjustment. Systems incorporating such antennas and methods of controlling them are also provided.

33 Claims, 9 Drawing Sheets

U.S. PATENT DOCUMENTS

| | | | | |
|---|---|---|---|---|
| 6,246,674 | B1 | 6/2001 | Feuerstein et al. | |
| 6,809,694 | B2 * | 10/2004 | Webb et al. | 343/754 |
| 7,043,280 | B1 * | 5/2006 | Shields et al. | 455/575.1 |
| 2004/0038714 | A1 * | 2/2004 | Rhodes et al. | 455/562.1 |
| 2007/0030208 | A1 * | 2/2007 | Linehan | 343/757 |

FOREIGN PATENT DOCUMENTS

| | | | |
|---|---|---|---|
| CA | 2333922 | | 6/1999 |
| EP | 0 543 509 | B1 | 7/1998 |
| EP | 0 600715 | B1 | 1/1999 |
| EP | 1 032 074 | | 8/2000 |
| EP | 0 984 508 | A3 | 8/2001 |
| GB | 2 288 913 | A | 11/2000 |
| WO | 96/14670 | | 5/1996 |
| WO | 01/03414 | | 1/2001 |
| WO | 01/06595 | | 1/2001 |
| WO | 02/37605 | | 5/2002 |
| WO | 02/47207 | | 6/2002 |

OTHER PUBLICATIONS

Two (2) pages from www.3gnewsroom.com/3g_news/oct_01/news_1247.shtml—Jul. 15, 2002.
One (1) page from www.kmwinc.com/eng/newproducts/contents/3way.htm—Jul. 15, 2002.
COMPENDEX AN 2000-064955659-M.
COMPENDEX AN 1998-053955707-M.
INSPEC AN 5248176.
INSPEC AN 5248191.
INSPEC AN 5249627.
INSPEC AN 4513248.
INSPEC AN 4658067.
INSPEC AN 6202654.
INSPEC AN 6202678.

* cited by examiner

CELLULAR ANTENNA AND SYSTEMS AND METHODS THEREFOR

CROSS-REFERENCE TO RELATED APPLICATIONS

This is a continuation-in-part of and claims the benefit of priority from application Ser. No. 10/312,979, filed Jul. 10, 2001 (PCT Filing Date), entitled Cellular Antenna, and currently pending.

FIELD OF THE INVENTION

This invention relates to a cellular antenna and systems incorporating the antenna as well as to methods of controlling the antenna. More particularly, although not exclusively, there is disclosed an antenna providing mechanical azimuth adjustment of the beam of the antenna in combination with adjustment with other antenna attributes.

BACKGROUND OF THE INVENTION

The applicant's prior application US2004/0038714A1 (Rhodes), the disclosure of which is incorporated by reference, discloses an antenna system providing remote electrical beam adjustment for down tilt, beam width and azimuth.

Systems for effecting mechanical adjustment of antenna beam azimuth are known but have not been well integrated into a cellular antenna. Whilst Rhodes discloses integrated antenna systems providing electrical attribute adjustment (e.g. down tilt, azimuth and beam width) there is a need for an antenna providing good integration of mechanical and electrical attribute adjustment.

Exemplary Embodiments

There is provided an antenna allowing mechanical azimuth adjustment in combination with adjustment of one or more other antenna attribute. An integrated control arrangement is provided which can utilise either serial, wireless or RF feed lines to convey communications. Systems incorporating such antennas and methods of controlling them are also provided. A number of embodiments are described and the following embodiments are to be read as non-limiting exemplary embodiments only.

According to one exemplary embodiment there is provided a cellular antenna comprising:

an array antenna rotatably mountable with respect to an antenna support so as to enable azimuth steering of the beam of the antenna;

an azimuth position actuator configured to rotate the array antenna with respect to an antenna support; and an actuator controller configured to receive control data associated with an address assigned to the actuator controller over an addressable serial bus and to control the azimuth position actuator in accordance with azimuth control data received.

According to another exemplary embodiment there is provided a network management system comprising a plurality of base station antenna sites, each with a group of antenna systems as described above.

According to another exemplary embodiment there is provided a cellular antenna comprising:

an array antenna rotatably mountable with respect to an antenna support so as to enable azimuth steering of the beam of the antenna having a first array of radiating elements for operation over a first frequency band and a second array of radiating elements for operation over a second frequency band;

an azimuth position actuator configured to rotate the array antenna with respect to an antenna support;

a first feed network configured to supply signals to and receive signals from the first array of radiating elements including an azimuth phase shifter to vary the phase of signals passing through the feed network;

an azimuth phase shifter actuator configured to adjust the azimuth phase shifter; and an actuator controller configured to receive control data and to control the azimuth position actuator in accordance with mechanical azimuth control data received to rotate the array antenna with respect to an antenna support to alter the direction of the antenna and to control the azimuth phase shifter actuator in accordance with electrical azimuth control data received to adjust the azimuth beam direction of the first array with respect to the azimuth beam direction of the second array.

According to another exemplary embodiment there is provided a method of adjusting beam azimuth for a multiband antenna having a first array and a second array in which the first array has a feed network including one or more variable element for adjusting beam azimuth, the method comprising:

mechanically orienting the antenna so as to achieve a desired azimuth beam direction for the second array; and setting the variable element so as to achieve a desired beam azimuth for the first array, different to the beam azimuth for the first array.

BRIEF DESCRIPTION OF THE DRAWINGS

The accompanying drawings which are incorporated in and constitute part of the specification, illustrate embodiments of the invention and, together with the general description of the invention given above, and the detailed description of embodiments given below, serve to explain the principles of the invention.

DESCRIPTION OF EMBODIMENTS OF THE INVENTION

Attributes of an antenna beam may be adjusted by physically orienting an antenna or by adjusting the variable elements in an antenna feed network. Physically adjusting the orientation of an antenna mechanically maintains a better radiation pattern for the antenna beam than by adjusting a variable element in the feed network. For down tilt a better radiation pattern is obtained by adjusting a variable element in the feed network than by mechanically orienting the antenna.

Figure 1:
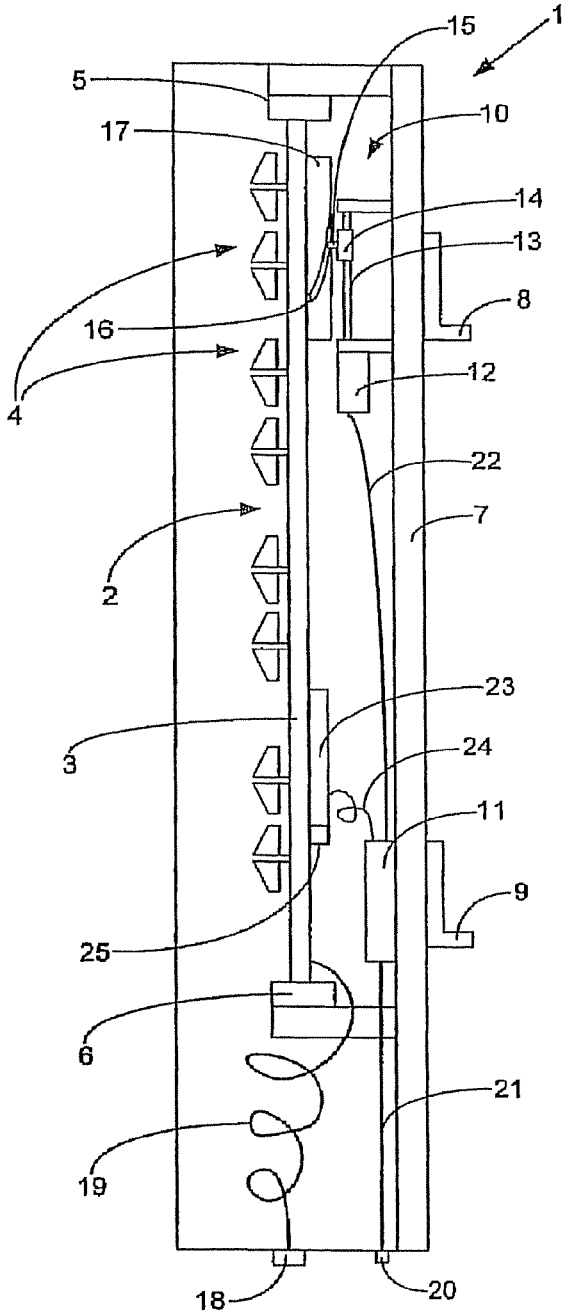
FIG. 1 shows a schematic side view of an antenna according to a first embodiment.

FIG. 1 shows a side view of a cellular antenna 1 according to a first embodiment. Antenna 1 includes an array antenna 2 having a reflector 3 and a plurality of radiating elements 4 (only some of which are indicated and the number of which may vary). Reflector 3 is rotatable about bearings 5 and 6 so that the array antenna 2 can rotate with respect to antenna support 7. Mounting brackets 8 and 9 allow the antenna to be mounted to a support structure such as a tower.

An azimuth position actuator 10 rotates array antenna 2 with respect to antenna support 7 in response to drive signals from actuator controller 11. Azimuth position actuator 10 includes a geared motor 12 driving a threaded shaft 13 which drives a nut 14 up and down as it rotates. Nut 14 has a pin 15 projecting therefrom which locates within a helical groove 16 in semi cylindrical guide 17. As pin 15 moves up and down guide 17 causes the array antenna 2 to rotate about its vertical axis to provide mechanical azimuth steering. It will be appreciated that a range of mechanical drive arrangements could be employed, such as geared drive trains, crank arrangements, belt and pulley drives etc.

In the embodiment shown in FIG. 1 an RF feed is supplied to connector 18 and a coiled feed line 19 supplies the RF feed to antenna array 2. In this embodiment control signals are provided to serial bus connector 20 and supplied to controller 11 via cable 21. Actuator controller 11 controls azimuth position actuator motor 12 via cable 22 and controls one or more actuator adjusting one or more variable element contained within variable feed assembly 23 via cable 24. Both cables 19 and 24 have excess length to enable ease of rotation of antenna array 2.

Variable feed assembly 23 may include a single phase shifter or multiple phase shifters to adjust down tilt. Variable feed assembly 23 may additionally or alternatively include one or more phase shifter or power divider to effect beam width adjustment. Variable feed assembly 23 may also include one or more phase shifter to effect electrical azimuth adjustment. Electrical azimuth adjustment may be provided for a multiband antenna so that the azimuth of the antenna beam of a first array may be adjusted mechanically and the antenna beam of a second array may be adjusted electrically to achieve a desired offset.

Actuator controller 11 may receive status and configuration information from variable feed assembly 23 such as the current position of phase shifters or power dividers or whether an actuator has a fault condition etc. A compass 25 may also be provided to give a real-time measurement as to the azimuth orientation of antenna array 2. The basic reading may be adjusted with respect to true North at the place of installation. This status and configuration information may be supplied from actuator controller 11 to a base station auxiliary equipment controller via a serial cable connected to connector 20.

In use serial data received by actuator controller 11 will include an address for an actuator controller along with data specifying desired operating parameters. When actuator controller 11 receives data associated with its address it controls actuators in accordance with control data for an attribute to be controlled. For example, actuator controller 11 may receive data for mechanical azimuth with a value of 222 degrees. Controller 11 obtains orientation information from compass 25 and drives motor 12 so as to rotate antenna 2 until the compass reading from compass 25 corresponds with the desired orientation. Likewise, controller 11 may receive data for a required down tilt angle. A down tilt phase shifter actuator, such as a geared motor, may drive one or more phase shifter in the feed network until an associated position sensor communicates to actuator controller 11 that the desired phase shifter position has been achieved (see U.S. Pat. No. 6,198,458, the disclosure of which is incorporated by reference). Likewise, beam width actuators and azimuth actuators may be driven by actuator controller 11 to achieve desired values.

In this way actuator controller 11 can control mechanical azimuth and electrical azimuth, down tilt and beam width in response to commands received from a addressable serial bus.

Figure 2A:
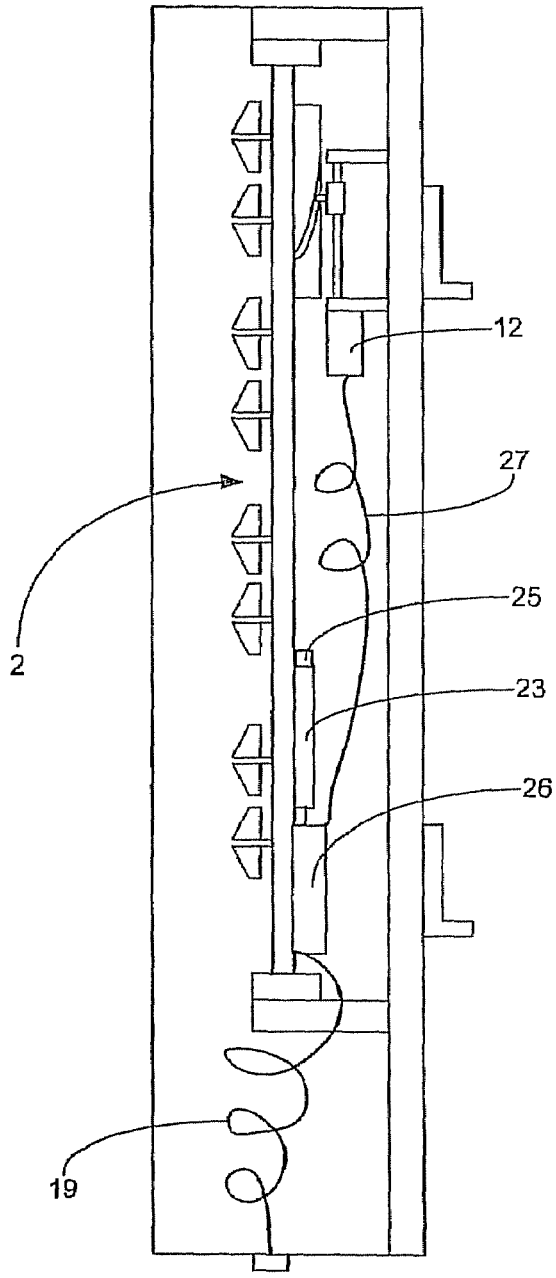
FIG. 2*a* shows a schematic side view of an antenna according to a second embodiment.

FIG. 2*a* shows a second embodiment in which all RF signals and control data are received over a single RF feed line. Like integers had been given like numbers to those shown in FIG. 1. In this embodiment RF feed line 19 supplies RF feed signals to antenna interface 26 which supplies RF signals to variable feed assembly 23 and extracts and supplies control data to actuator controller 23. As antenna interface 26 is mounted to reflector 3 a flexible control cable 27 is provided to azimuth motor 12. Antenna interface 26 may extract power supplied by an RF feed line to operate actuator controller 23 and it associated actuators. A DC bias voltage may be applied to the RF feed line at the base of a cellular base station tower and extracted by antenna interface 26 at the top of the tower. This arrangement has the advantage that only a single RF feed line need be connected to each antenna to provide both RF signals and control data.

Figure 2B:
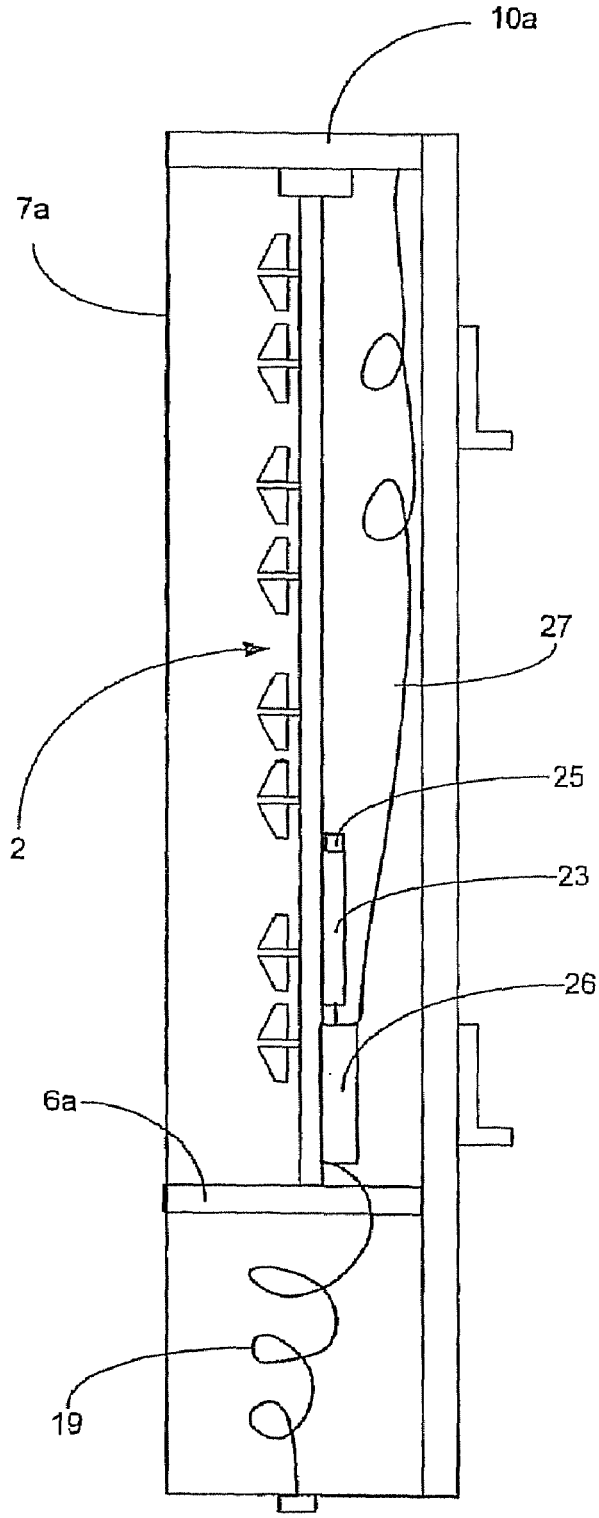
FIG. 2*b* shows a schematic side view of an antenna according to a third embodiment.

FIG. 2*b* shows a variant of the embodiment shown in FIG. 1 where the azimuth position actuator 10*a* is in the form of a top mounted geared motor which supports antenna 2 and rotates it. The base of the antenna is maintained in position by bearing 6*a* secured to the base of the antenna and extending to the walls of the radome 7*a*.

Figure 3A:
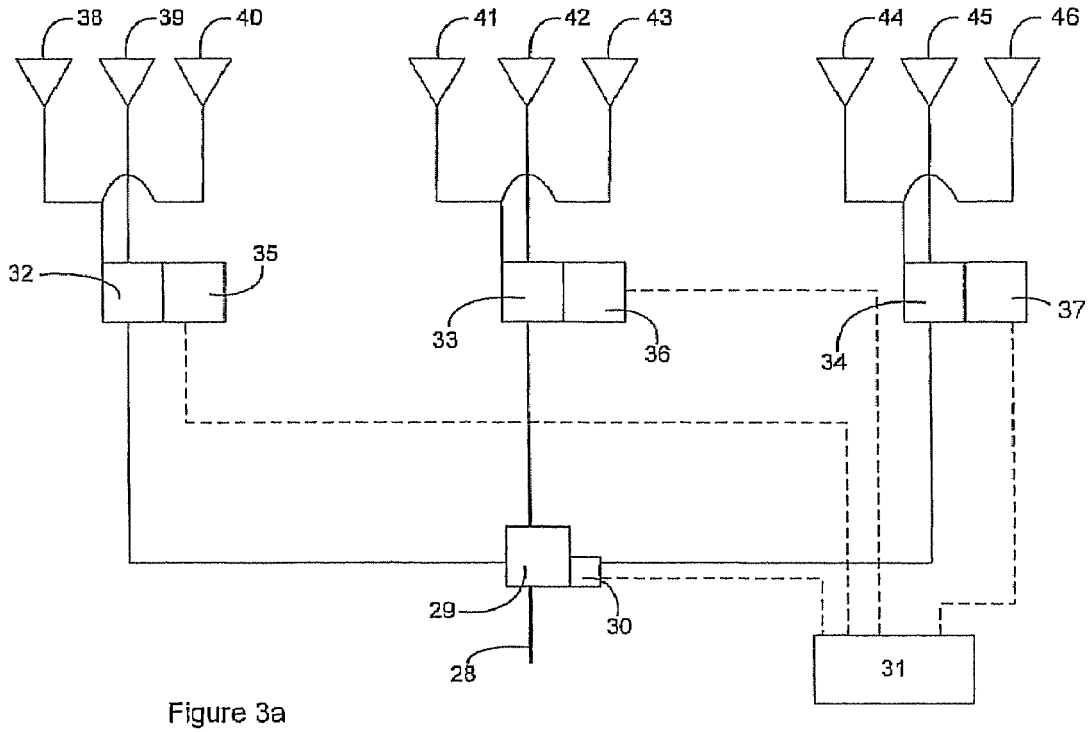
FIG. 3*a* shows a schematic view of a feed arrangement for an antenna of the type shown in FIGS. 1 and 2.

Referring now to FIG. 3 there is shown a feed arrangement suitable for adjusting the down tilt and the beam width of the beam of an antenna of the type shown in FIGS. 1 and 2. In this case the antenna includes three rows 38 to 40, 41 to 43 and 44 to 46 of radiating elements although it will be appreciated that any desired number may be employed. RF feed line 28 feeds differential phase shifter 29. Actuator 30 is driven by actuator controller 31 to adjust the position of the variable differential phase shifter 29 to achieve a desired beam down tilt. Actuators 35 to 37 are driven by controller 31 to adjust power dividers 32 to 34 to adjust antenna beam width.

Figure 9:
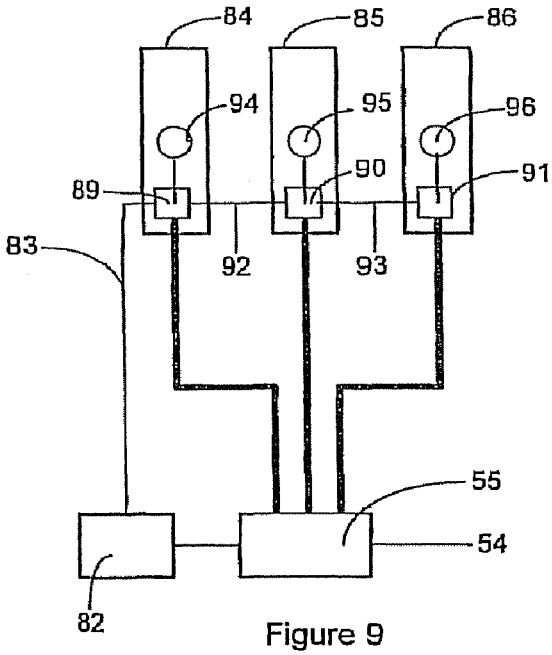
FIG. 9 shows a schematic diagram of a data communications arrangement for the cellular base station shown in FIG. 8.

A number of feed arrangements utilising variable elements may be employed, some examples of which are set out in US2004/0038714A1 which is incorporated herein by reference. FIG. 9 in particular shows an embodiment including a down tilt phase shifter driven by a down tilt phase shifter actuator, power dividers driven by power divider actuators and azimuth phase shifters driven by azimuth phase shifter actuators to effect down tilt, beam width and azimuth adjustment of the antenna beam. It will be appreciated that any one or combination of attributes may be adjusted depending upon the application. In a simple application electrical down tilt adjustment may be provided with mechanical azimuth adjustment.

Figure 3B:
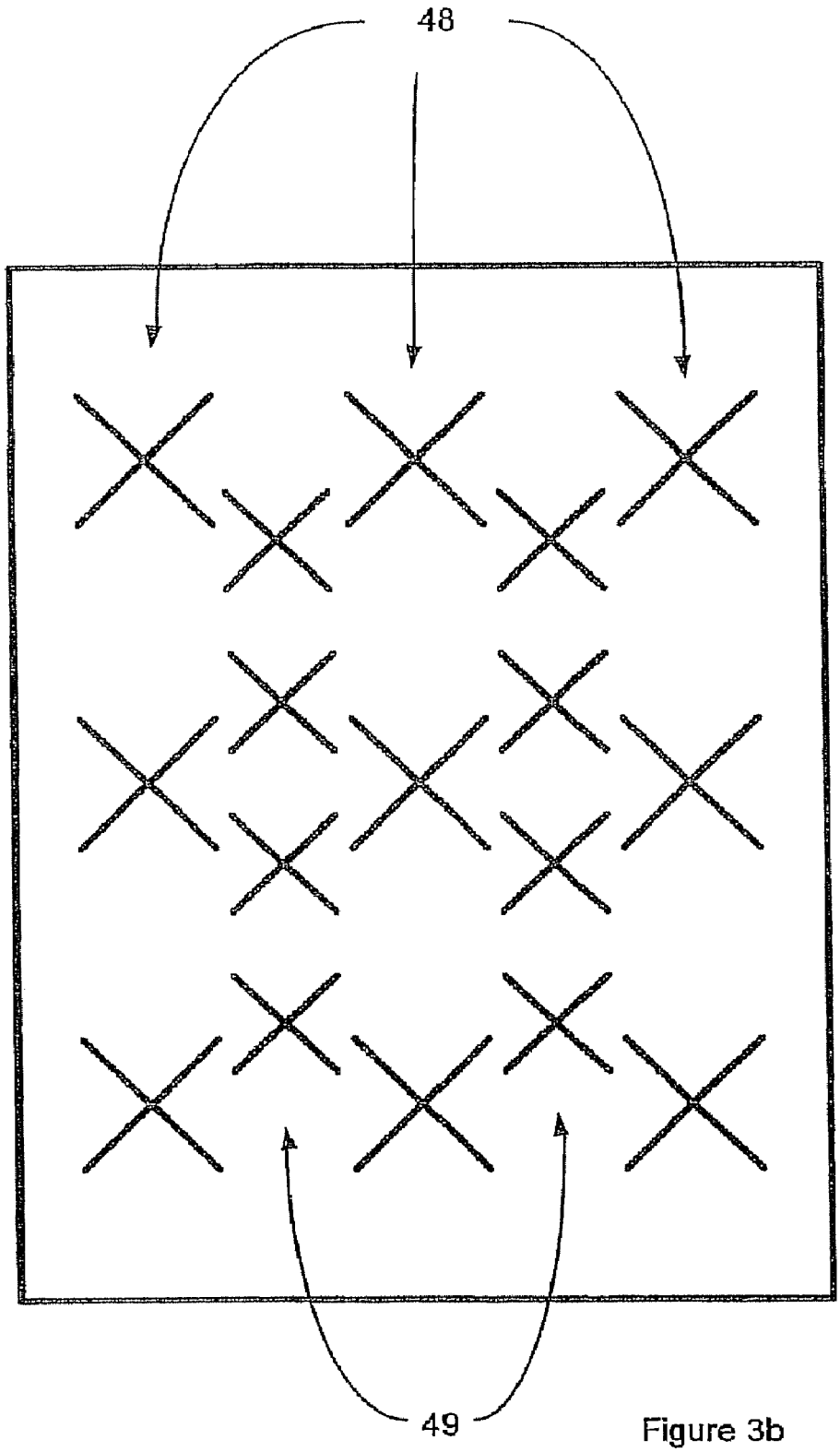
FIG. 3*b* shows a schematic view of a multiband antenna embodiment.

In the multi-array embodiment shown in FIG. 3*b* a first array of columns of radiating elements 48 may have a feed network as shown in FIG. 3 whilst the second array of columns of radiating elements 49 may have a feed network as shown in FIG. 9 of US2004/0038714A1. In this way the beam direction for the first array may be set mechanically by mechanically orienting the antenna and the beam direction for the second array may be offset using electrical azimuth adjustment in the feed network. The arrays may operate in the same or different frequency bands. In the embodiment shown in FIG. 3*b* array 49 operates in a higher band than array 48.

Figure 4:
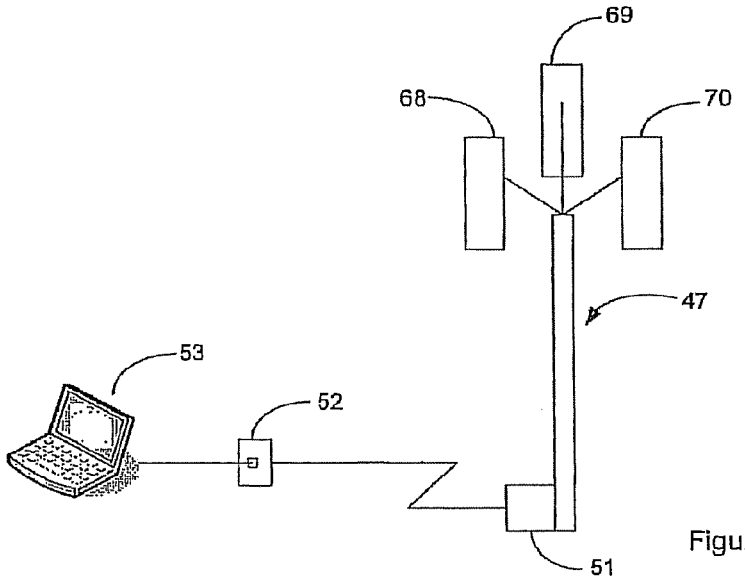
FIG. 4 shows a schematic diagram of a cellular base station in which control data is sent via one or more RF feed line.

Referring now to FIG. 4 a schematic diagram of an antenna base station 47 having three antennas 68, 69 and 70 is shown. Auxiliary equipment controller 51 includes a connector 52 allowing a laptop 53 to interface with base station auxiliary equipment controller 51.

Figure 5:
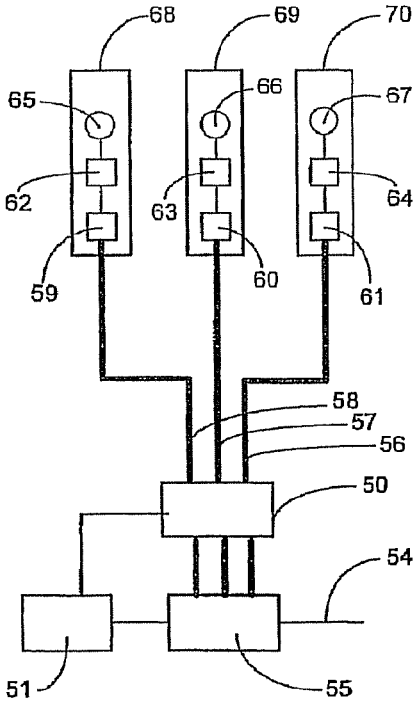
FIG. 5 shows a schematic diagram of a first data communications arrangement for the cellular base station shown in FIG. 4.

FIG. 5 shows a first embodiment in which a base station controller 55 communicates with a central controller via a backhaul link 54. Commands for controlling antenna attributes are sent from base station controller 55 to auxiliary equipment controller 51. A modulation/demodulation arrangement conveys commands between control interface 50 and antenna interfaces 59 to 61. Base station controller 55 sends RF signals for transmission via RF feed lines 57 to control interface 50. Auxiliary equipment controller 51 sends commands for controlling controllable antenna elements to control interface 50 which superposes control commands onto RF feed lines 56 to 58. Each antenna includes an antenna interface 59 to 61 which extracts the superposed control commands and provides these to controller actuators 62 to 64 which control actuators 65 to 67 of antennas 68 to 70. It will be appreciated that any number of actuators may be controlled and that these may include control motors to adjust the physical position of an antenna, actuators to adjust phase shifters, actuators to adjust power dividers or other adjustable elements. The control data will include an address for an actuator controller along with control data designating the attribute to be controlled (e.g. down tilt) and a desired value. The actuator controllers may also send status and configuration information to antenna interface is 59 to 61 to be conveyed via control interface 50 to auxiliary equipment controller 51. This status and configuration information may be supplied to a central controller via backhaul link 54.

Figure 6:
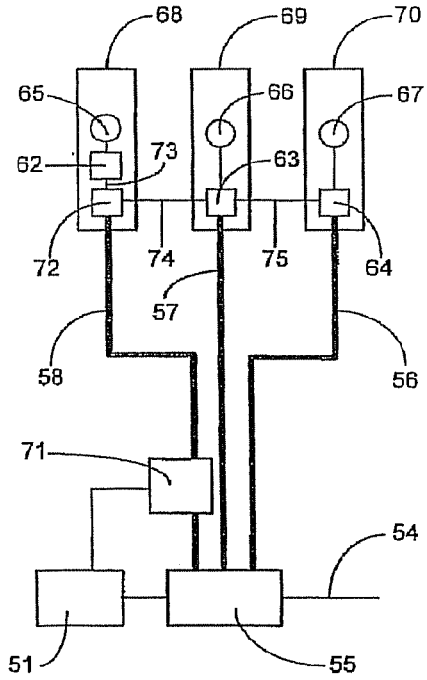
FIG. 6 shows a schematic diagram of a second data communications arrangement for the cellular base station shown in FIG. 4.

FIG. 6 shows a modified version in which like integers and have been given like numbers. In this case the control interface 71 superposes the control data only on RF line 58. An antenna interface 72 is incorporated within antenna 68 and this provides the control data to actuator controllers 62 to 64 via serial cables 73 to 75. This arrangement reduces cost by only requiring a single antenna interface 72 and for control interface 71 to interface only with one feed cable.

Figure 7:
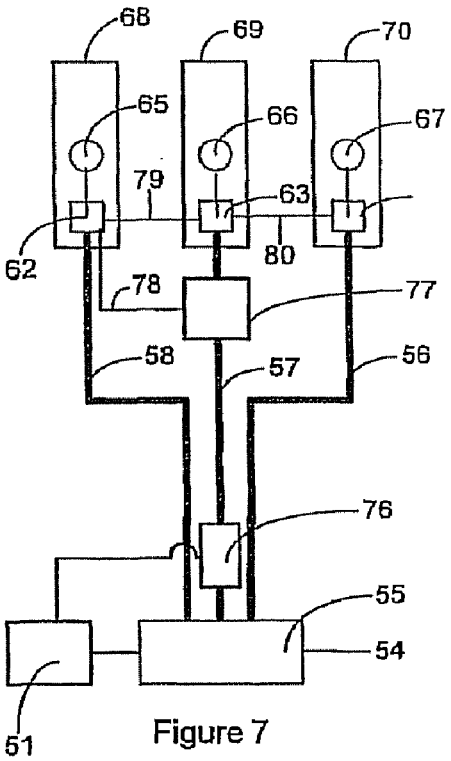
FIG. 7 shows a schematic diagram of a third data communications arrangement for the cellular base station shown in FIG. 4.

FIG. 7 shows an embodiment similar to FIG. 6 except that the antenna interface 77 is located externally to antennas 68 to 70 at the top of a tower. Actuator controllers 62 to 64 are supplied with control data via serial bus connections 78 to 80. This arrangement has the advantage that a standardised antenna unit 68 to 70 may be employed whether control data either is sent up the tower via an RF feed line or a serial cable.

Figure 8:
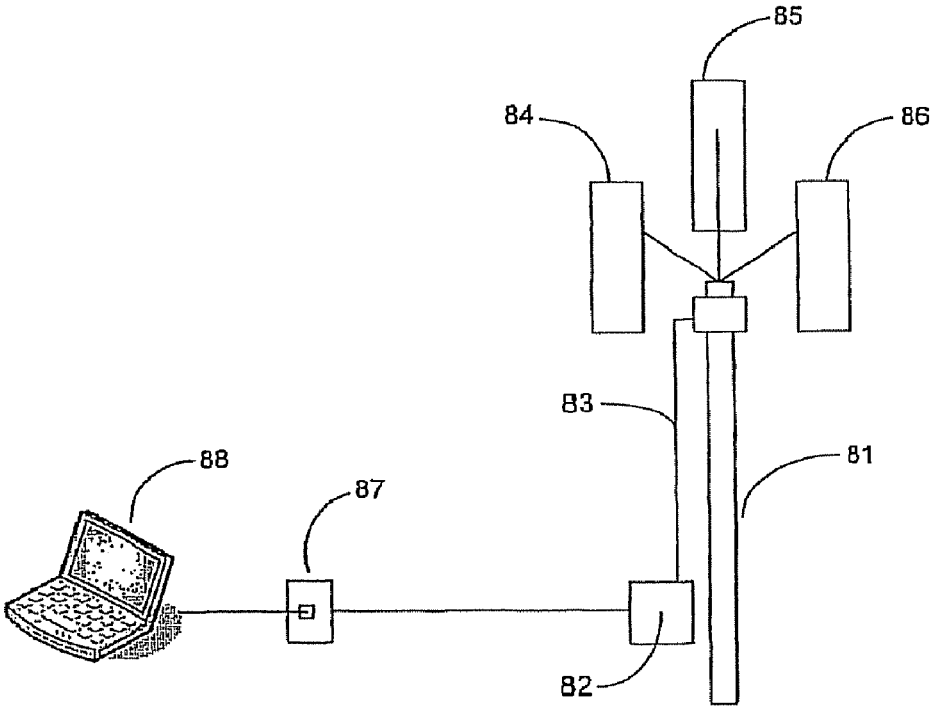
FIG. 8 shows a schematic diagram of a cellular base station in which control data is sent via a serial bus.

FIG. 8 shows an embodiment in which control data is sent up tower 81 from auxiliary equipment controller 82 via serial cable 83 to antennas 84 to 86. An access port 87 is provided to enable a portable controller (e.g. a laptop) 88 to communicate directly with auxiliary equipment controller 82 to effect local control. As shown in FIG. 9 actuator controllers 89 to 91 and auxiliary equipment controller 82 are interconnected by serial buses 83, 92 and 93. Actuators 94 to 96 are controlled by actuator controllers 89 to 91 in accordance with control data received from auxiliary equipment controller 82. Status and configuration information from actuator controllers 89 to 91 is communicated via the serial bus to auxiliary equipment controller 82.

Figure 10:
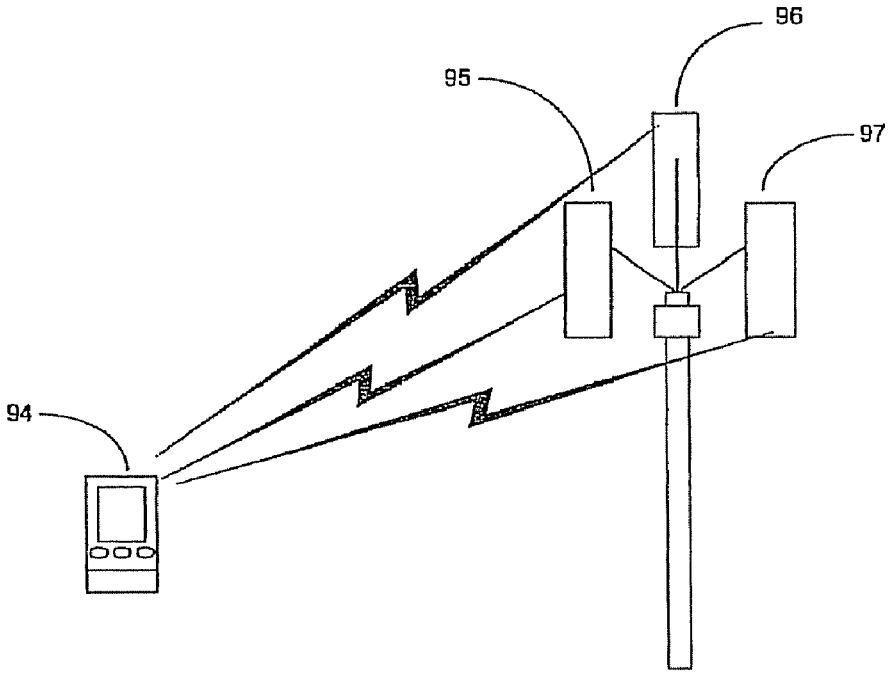
FIG. 10 shows a schematic diagram of a cellular base station in which control data is sent via a wireless link.

FIG. 10 shows a wireless embodiment in which control data is communicated between a controller 94 and antennas 95 to 97 directly via a wireless link. It will be appreciated that controller 94 may be an auxiliary equipment controller at the base station supporting wireless communication or a portable device such as a laptop with a wireless card etc. Controller 94 may also be remotely located and control antennas 95 to 97 via a long-range radio link.

Figure 11:
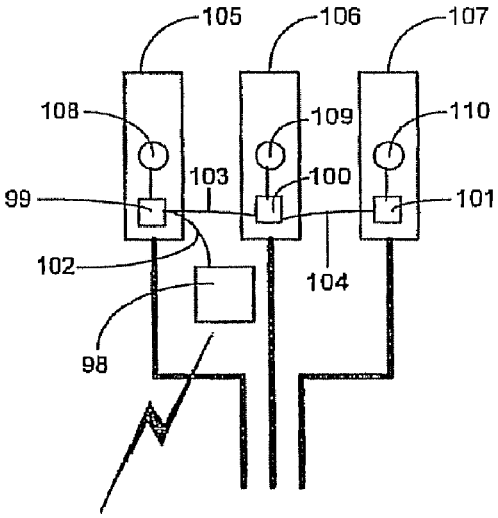
FIG. 11 shows a schematic diagram of a first data communications arrangement for the cellular base station shown in FIG. 10.

FIG. 11 shows a first embodiment in which a single antenna interface 98 communicates wirelessly with a controller 94 and communicates with actuator controllers 99 to 101 via serial bus 102 to 104 to control actuators 108 to 110. This arrangement allows standard antennas 105 to 107 having serial interfaces to be employed.

Figure 12:
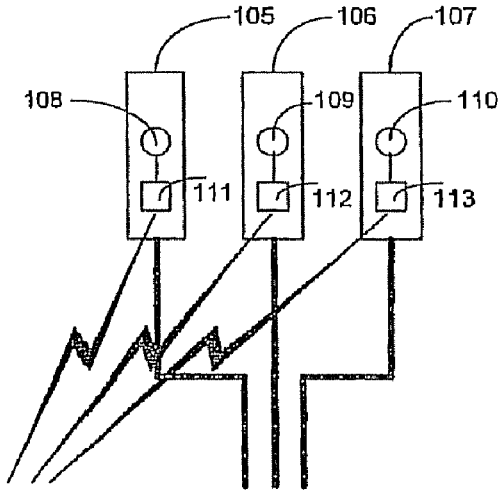
FIG. 12 shows a schematic diagram of a second data communications arrangement for the cellular base station shown in FIG. 10.

FIG. 12 shows an embodiment in which actuator controllers 111 to 113 include wireless communication circuits enabling each actuator controller 111 to 113 to communicate directly with a controller 94.

Figure 13:
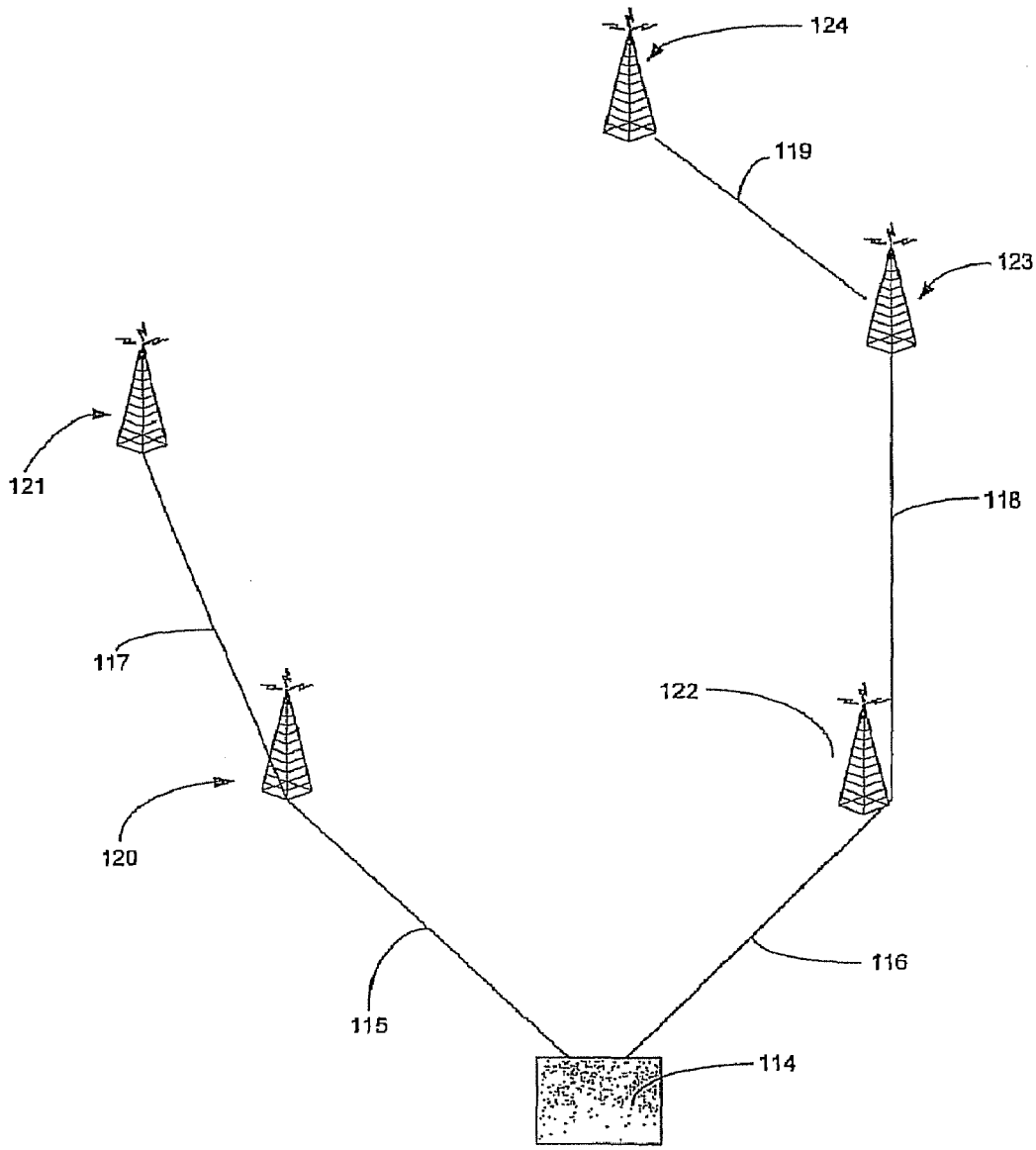
FIG. 13 shows a schematic diagram of a network management system.

FIG. 13 shows schematically a network management system in which a central controller 114 communicates via backhaul links 115 to 119 with a number of base stations 120 to 124. Central controller 114 obtains status and configuration information from each base station controller and sends control data to base stations 120 to 124. Central controller 114 may periodically receive status and configuration information and/or status and configuration information may be sent on request or whenever there is a change. Central controller 114 may adjust antenna attributes according to a schedule, on operator command or actively in response to current operating conditions (e.g. traffic demands etc).

There is thus provided an antenna providing azimuth and down tilt adjustment which maintains good radiation patterns of the antenna. A common controller enables mechanical azimuth, electrical down tilt, electrical beam width and electrical azimuth actuators to be commonly controlled. An addressable serial bus interface simplifies interconnection of antennas and controllers. Control data may be sent via an RF feed line, serial data cable or wireless connection. For multi-band applications the combination of mechanical and electrical azimuth adjustment allows azimuth to be independently adjusted for two or more arrays.

While the present invention has been illustrated by the description of the embodiments thereof, and while the embodiments have been described in detail, it is not the intention to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departure from the spirit or scope of the Applicant's general inventive concept.

The invention claimed is:

1. A cellular antenna comprising:

an array antenna rotatably mountable with respect to an antenna support so as to enable azimuth steering of the beam of the antenna;

an azimuth position actuator configured to rotate the array antenna with respect to the antenna support; and an actuator controller configured to receive control data associated with an address assigned to the actuator controller over an addressable serial bus and to control the azimuth position actuator in accordance with azimuth control data received.

2. The antenna of claim 1 further comprising a radome within which said array antenna is rotatably supported.

3. The antenna of claim 2 wherein said antenna support includes an antenna suspension structure adapted to provide primary physical support for the antenna at the top of the radome.

4. The antenna of claim 2 wherein the azimuth position actuator is configured to rotate the array antenna at the top of the radome.

5. An antenna system including at least one array antenna assembly as defined in claim 1 and a control arrangement including a base station controller adapted to develop said control data for transmission to said actuator controller.

6. The antenna system as claimed in claim 5 including a modulation/demodulation arrangement configured to communicate control data between the base station controller and the actuator controller over an RF feed line.

7. The antenna system as claimed in claim 6 wherein the addressable serial bus is an RS485 bus.

8. The antenna system as claimed in claim 5 including a wireless communications arrangement configured to communicate control data between the base station controller and the actuator controller.

9. The antenna system as claimed in claim 5 including an addressable serial bus connected directly between the base station controller and the actuator controller.

10. A network management system comprising a plurality of base station antenna sites, each with a group of antenna systems as defined in claim 5, said network management system including a central controller configured to communicate with individual actuator controllers through the base station controllers of said antenna systems.

11. The network management system of claim 10 wherein said central controller communicates with said base station controllers using an Internet protocol.

12. The antenna as claimed in claim 1, further including:

a feed network configured to supply signals to and receive signals from an array of spaced apart radiating elements of the array antenna, the feed network including a down tilt phase shifter to vary the phase of signals passing through the feed network;

a down tilt phase shifter actuator configured to adjust the down tilt phase shifter;

wherein the actuator controller is configured to control the down tilt phase shifter actuator in accordance with down tilt control data received to adjust the down tilt of the beam of the array antenna.

13. The antenna as claimed in claim 12 wherein the actuator controller is an integrated controller controlling both the azimuth position actuator and the down tilt phase shifter actuator.

14. The antenna as claimed in claim 12 wherein the feed network includes a plurality of down tilt phase shifters to vary the phase of signals passing through the feed network and a plurality of down tilt phase shifter actuators controlled by the actuator controller.

15. The antenna as claimed in claim 12, further including:

a beam width phase shifter to vary the phase of signals passing through the feed network;

a beam width phase shifter actuator configured to adjust the beam width phase shifter;

wherein the actuator controller is configured to control the beam width phase shifter actuator in accordance with beam width control data received to adjust the beam width of the beam of the array antenna.

16. The antenna as claimed in claim 12, further including:

a power divider to vary the power of signals passing through different branches of the feed network;

a power divider actuator configured to adjust the power divider;

wherein the actuator controller is configured to control the power divider actuator in accordance with beam width control data received to adjust to the beam width of the beam of the array antenna.

17. The antenna as claimed in claim 1, further including:

a feed network configured to supply signals to and receive signals from an array of spaced apart radiating elements of the array antenna, the feed network including a beam width phase shifter to vary the phase of signals passing through the feed network;

a beam width phase shifter actuator configured to adjust the beam width phase shifter;

wherein the actuator controller is configured to control the beam width phase shifter actuator in accordance with beam width control data received to adjust the beam width of the beam of the array antenna.

18. The antenna as claimed in claim 1, further including:

a feed network configured to supply signals to and receive signals from an array of spaced apart radiating elements of the array antenna, the feed network including a power divider to adjust the relative power of signals passing through different branches of the feed network; and a power divider actuator configured to adjust the power divider;

wherein the actuator controller is configured to control the power divider actuator in accordance with beam width control data received to adjust the beam width of the beam of the array antenna.

19. The antenna as claimed in claim 1, further including a compass attached to the array antenna, such that the compass reading is indicative of an azimuth beam direction of the array antenna.

20. The antenna as claimed in claim 19, wherein the compass sends compass readings to the controller.

21. The antenna as claimed in claim 20, wherein the control data includes a signal specifying a desired azimuth beam direction and wherein the controller is configured to control the azimuth position actuator based on the compass reading and the desired azimuth beam direction.

22. The antenna as claimed in claim 20, wherein the controller is configured to correct the compass reading for the offset between magnetic and true north.

23. A cellular antenna system comprising:

a central control system and at least two antennas as claimed in claim 1;

wherein the controllers are configured to receive control signals from the central control system over a single addressable serial bus.

24. An antenna system as claimed in claim 23, wherein:

each antenna includes a compass attached to its array antenna, such that the compass reading is indicative of the antenna's azimuth beam direction;

the compass reading is sent to the central control system, which is configured to send control signals to the appropriate controller instructing control of the azimuth actuator to bring the compass reading into agreement with a desired azimuth beam direction.

25. A cellular antenna comprising:

an array antenna rotatably mountable with respect to an antenna support so as to enable azimuth steering of the beam of the antenna having a first array of radiating elements for operation over a first frequency band and a second array of radiating elements for operation over a second frequency band;

an azimuth position actuator configured to rotate the array antenna with respect to an antenna support;

a first feed network configured to supply signals to and receive signals from the first array of radiating elements including an azimuth phase shifter to vary the phase of signals passing through the feed network;

an azimuth phase shifter actuator configured to adjust the azimuth phase shifter; and an actuator controller configured to receive control data and to control the azimuth position actuator in accordance with mechanical azimuth control data received to rotate the antenna with respect to an antenna support to alter the direction of the antenna and to control the azimuth phase shifter actuator in accordance with electrical azimuth control data received to adjust the azimuth beam direction of the first array with respect to the azimuth beam direction of the second array.

26. The cellular antenna as claimed in claim 25 wherein the first frequency band is different from the second frequency band.

27. The cellular antenna as claimed in claim 25 wherein the actuator controller is configured to receive control data over an addressable serial bus associated with an address assigned to the actuator controller.

28. The cellular antenna as claimed in claim 25 wherein the first feed network includes a down tilt phase shifter and a down tilt phase shifter actuator responsive to drive signals from the actuator controller to adjust down tilt of the beam of the first array.

29. The cellular antenna as claimed in claim 28 wherein the first feed network includes a beam width phase shifter and a beam width phase shifter actuator responsive to drive signals from the actuator controller to adjust beam width of the first array.

30. The cellular antenna as claimed in claim 28 wherein the first feed network includes a beam width power divider and a beam width power divider actuator responsive to drive signals from the actuator controller to adjust beam width of the first array.

31. The cellular antenna as claimed in claim 25 wherein the first feed network includes a beam width phase shifter and a beam width phase shifter actuator responsive to drive signals from the actuator controller to adjust beam width of the first array.

32. The cellular antenna as claimed in claim 25 wherein the first feed network includes a beam width power divider and a beam width power divider actuator responsive to drive signals from the actuator controller to adjust beam width of the first array.

33. A method of adjusting beam azimuth for a multi-array antenna having a first array and a second array in which the first array has a feed network including one or more variable element for adjusting beam azimuth, the method comprising:

mechanically orienting the antenna so as to achieve a desired azimuth beam direction for the second array; and setting the variable element so as to achieve a desired beam azimuth for the first array, different to the beam azimuth for the second array.

* * * * *